US005297307A

United States Patent [19]

Baek

[11] Patent Number: 5,297,307

[45] Date of Patent: Mar. 29, 1994

[54] WASHING MACHINE AND METHOD OF CONTROLLING SUCH

[75] Inventor: Seung T. Baek, Kyungsangnam-do, Rep. of Korea

[73] Assignee: Goldstar Co., Ltd., Seoul, Rep. of Korea

[21] Appl. No.: 47,177

[22] Filed: Apr. 16, 1993

[51] Int. Cl.[5] ..... D06F 33/02

[52] U.S. Cl. ..... 8/159; 68/12.02; 68/12.04; 68/12.05

[58] Field of Search ..... 8/158, 159; 68/12.01, 68/12.02, 12.04, 12.05

[56] References Cited

FOREIGN PATENT DOCUMENTS 22889 1/1986 Japan ..... 68/12.01
49997 10/1986 Japan ..... 68/12.01
12197 1/1991 Japan ..... 68/12.01

*Primary Examiner*—Philip R. Coe

*Attorney, Agent, or Firm*—Finnegan, Henderson, Farabow, Garrett & Dunner

[57] ABSTRACT

A washing machine and a method of controlling such, wherein the washing of laundry articles can be performed according to user preference. According to the invention, a plurality of washing factors, which are selected by the user, are stored in an accumulated manner in a memory during a manual washing operation of the washing machine. In an automatic washing operation of the washing machine, the washing factors stored in the memory when the manual washing operation was performed are analyzed for recognition of those factors which the user likes best. A plurality of washing factors are inferred from a plurality of washing information regarding conditions in the washing bath. Then, self-learning is performed based on the inferred washing factors and the recognized washing factors to determine a plurality of final washing factors. The automatic washing operation is performed according to the determined final washing factors.

17 Claims, 6 Drawing Sheets

| AMOUNT OF LAUNDRY ARTICLES | (N)FREQU-ENCY | LEVEL OF WASHING WATER | | | | WASHING TIME (MIN) | | | | NUMBER OF RINSING TIMES | | | | HYDRATING TIME (MIN) | | | |
|---|---|---|---|---|---|---|---|---|---|---|---|---|---|---|---|---|---|
| | | MINI-MUM | LOW | MIDDLE | HIGH | 3 | 9 | 12 | 18 | 1 | 2 | 3 | 4 | 1 | 3 | 5 | 7 |
| 0 ~ 2 Kg | N1 | H1a | H1b | H1c | H1d | T1a | T1b | T1c | T1d | X1a | X1b | X1c | X1d | Y1a | Y1b | Y1c | Y1d |
| 2 ~ 3 Kg | N2 | H2a | H2b | H2c | H2d | T2a | T2b | T2c | T2d | X2a | X2b | X2c | X2d | Y2a | Y2b | Y2c | Y2d |
| 3 ~ 4 Kg | N3 | H3a | H3b | H3c | H3d | T3a | T3b | T3c | T3d | X3a | X3b | X3c | X3d | Y3a | Y3b | Y3c | Y3d |
| 4 ~ 5 Kg | N4 | H4a | H4b | H4c | H4d | T4a | T4b | T4c | T4d | X4a | X4b | X4c | X4d | Y4a | Y4b | Y4c | Y4d |
| 5 ~ Kg | N5 | H5a | H5b | H5c | H5d | T5a | T5b | T5c | T5d | X5a | X5b | X5c | X5d | Y5a | Y5b | Y5c | Y5d |

FIG. 6a

| AMOUNT OF LAUNDRY ARTICLES | (N)FREQU-ENCY | LEVEL OF WASHING WATER | | | | WASHING TIME (MIN) | | | | NUMBER OF RINSING TIMES | | | | HYDRATING TIME (MIN) | | | |
|---|---|---|---|---|---|---|---|---|---|---|---|---|---|---|---|---|---|
| | | MINI-MUM | LOW | MIDDLE | HIGH | 3 | 9 | 12 | 18 | 1 | 2 | 3 | 4 | 1 | 3 | 5 | 7 |
| 0 ~ 2 Kg | 10 | 2 | 7 | 1 | 0 | 0 | 3 | 7 | 0 | 0 | 0 | 9 | 1 | 5 | 3 | 1 | 1 |
| | | | Href | | | | | Tref | | | | Xref | | Yref | | | |

FIG. 6b

WASHING MACHINE AND METHOD OF CONTROLLING SUCH

BACKGROUND OF THE INVENTION

1. Field of the Invention

The present invention relates in general to washing machines, and more particularly to a washing machine and a method of controlling such, wherein the washing of laundry articles can be performed according to a user's preference.

2. Description of the Prior Art

The whole operation of a washing machine is generally performed according to four washing factors. The washing factors include washing time, level of the washing water, the number of rinsing times, and dehydrating time, which are automatically or manually selected by the user. One example of this type of washing machine is schematically shown in block form in FIG. 1.

As shown in FIG. 1, the conventional washing machine comprises a key signal generator 1 for generating a washing mode signal to select either automatic or manual washing operation and the four washing factors to determine a washing pattern, according to a user's selection, a laundry amount sensor 2 for sensing an amount of laundry articles in a washing bath, a turbidity sensor 3 for sensing a turbidity of washing water in the washing bath, a level sensor 4 for sensing a level of the washing water in the washing bath, a microcomputer 5 for generating a plurality of control signals to perform the washing of the laundry articles according to the washing information from the key signal generator 1, the laundry amount sensor 2, the turbidity sensor 3 and the level sensor 4, a load section 6 including a washing motor, a hydrating motor, a display unit and valves, and a load driving circuit 7 for generating a plurality of drive signals necessary to the driving of the load section 6 in response to the control signals from the microcomputer 5.

The operation of controlling the washing machine of the construction in FIG. 1 is classified into the automatic and manual washing operations as mentioned above. Namely, the user operates the key signal generator 1 to generate the washing mode signal corresponding to either the manual or automatic washing operation. Then, the microcomputer 5 receives the washing mode signal and generates the control signals in accordance with the washing mode selected.

The automatic and manual washing operations of the conventional washing machine with the construction in FIG. 1 will hereinafter be described with reference to FIG. 2, which is a flowchart illustrating a method of controlling the conventional washing machine.

MANUAL WASHING OPERATION

When the manual washing operation is selected by the user, the key signal generator 1 generates the washing mode signal corresponding to the manual washing operation. Also, the key signal generator 1 generates the washing factors corresponding to the level of the washing water, the washing time, the number of rinsing times, and the hydrating time, which are selected by the user. The microcomputer 5 recognizes the manual washing operation in response to the washing mode signal from the key signal generator 1 and then sets the level of the washing water, the washing time, the number of rinsing times and the hydrating time in response to the washing factors from the key signal generator 1.

Thereafter, the microcomputer 5 controls the load driving circuit 7, which drives the load section 6, so that the washing water is supplied into the washing bath. At this time, the level sensor 4 senses the level of the washing water in the washing bath and provides the sensed result to the microcomputer 5. When the sensed level of the washing water reaches a set level, the microcomputer 5 controls the load driving circuit 7 to drive the load section 6, so that the washing water supply into the washing bath is cut off. Then, the microcomputer 5 initiates the washing of the laundry articles for the set washing time and then performs the hydration of the laundry articles for the set hydrating time.

Finally, the microcomputer 5 initiates the rinsing of the laundry articles for a predetermined time period and then checks whether the number of rinsing times has reached a set number of times. When the number of rinsing times reaches the set number of times, the microcomputer 5 completes the whole manual washing operation. On the contrary, when the number of rinsing times is has not reached the set number of times, the microcomputer 5 repeats the above hydration of the laundry articles until the number of rinsing times reaches the set number of times. That is, the rinsing of the laundry articles and hydration is performed repeatedly for a set number of times.

AUTOMATIC WASHING OPERATION

When the automatic washing operation is selected by the user, the key signal generator 1 generates the washing mode signal corresponding to the automatic washing operation. The microcomputer 5 recognizes the automatic washing operation in response to the washing mode signal from the key signal generator 1 and then controls the load driving circuit 7 to drive the load section 6, so that the washing water is supplied into the washing bath to a measurable level. At this time, the level sensor 4 senses the level of the washing water in the washing bath and provides the sensed result to the microcomputer 5. Also, the laundry amount sensor 2 senses the amount of the laundry articles in the washing bath and provides the sensed result to the microcomputer 5. The microcomputer 5 sets the level of the washing water and the hydrating time according to the sensed amount of the laundry articles.

Then, the load driving circuit 7 drives the load section 6 under the control of the microcomputer 5, so that the washing water is supplied into the washing bath to the set level. When the microcomputer 5 determines that the washing water has been filled in the washing bath to the set level, according to the sensed washing water level from the level sensor 4, the microcomputer 5 controls the load driving circuit 7 to drive the load section 6, so that the washing of the laundry articles is started.

During the washing of the laundry articles, the turbidity sensor 3 senses the turbidity of the washing water in the washing bath and provides the sensed result to the microcomputer 5. The microcomputer 5 sets the washing time in accordance with the sensed turbidity of the washing water. When the set washing time has elapsed, the microcomputer 5 controls the load driving circuit 7 to drive the load section 6, so that it completes the washing operation and performs the hydration of the laundry articles for the set hydrating time.

Upon completion of the hydration of the laundry articles, the microcomputer 5 controls the load driving circuit 7 to drive the load section 6, so that the rinsing of the laundry articles is performed. During the rinsing of the laundry articles, the turbidity sensor 3 senses the turbidity of the washing water in the washing bath and provides the sensed result to the microcomputer 5. The microcomputer 5 sets the number of times for further rinsing in accordance with the sensed turbidity of the washing water. Then, the microcomputer 5 checks whether the number of rinsing times has reached a set number of times. When the number of rinsing times reaches the set number of times, the microcomputer 5 completes the whole automatic washing operation. But, when the number of rinsing times has not reached the set number of times, the microcomputer 5 repeats the above hydration of the laundry articles until the number of rinsing times reaches the set number of times.

However, in the conventional washing machine, the automatic washing operation is preset in a system program and performed according to the sensed amount of the laundry articles and the sensed turbidity of the washing water. This causes the automatic washing operation not to be performed according to a user's preference. In other words, the users may select different washing factors with respect to the same laundry articles according to their preferences. Each user may have a particular preference as to the length of washing time, the level of the washing water, the number of rinsing times and the length of hydrating time. For example, a certain user may prefer a longer washing time, one or two more rinsing times, and a higher level of the washing water, than those of others with respect to the same laundry articles. However, the conventional washing machine is only capable of performing the automatic washing operation according to the sensed amount of the laundry articles and the sensed turbidity of the washing water regardless of the user's preference. This results in an inconvenience to the user when using the washing machine in the automatic washing operation.

SUMMARY OF THE INVENTION

Therefore, the present invention has been made in view of the above problem, and it is an object of the present invention to provide a washing machine and a method of controlling such, wherein the washing of laundry articles can be performed according to a washing pattern which is based on a user's preference through self-learning.

In accordance with one aspect of the present invention, a washing machine comprises a key signal generating means for generating a washing mode signal to select either automatic or manual washing operation and a plurality of washing factors which are necessary for manual washing operation, according to a user's selection; a washing information sensing means for sensing a plurality of conditions in a washing bath; a memory means for storing in an accumulated manner the plurality of washing factors from the key signal generating means which are selected by the user whenever the manual washing operation is performed; a control means for recognizing one of the manual and automatic washing operations in response to the washing mode signal from the key signal generating means, controlling the manual washing operation in accordance with the plurality of washing factors from the key signal generating means and the plurality of washing information from the washing information sensing means, inferring a plurality of washing factors from the plurality of washing information from the washing information sensing means and controlling the automatic washing operation according to the inferred washing factors and the plurality of washing factors stored in the memory means in the manual washing operation; a load means for executing the automatic and manual washing operations of the washing machine; and a load driving means for driving the load means suitable to the automatic washing operation or the manual washing operation under the control of the control means.

In accordance with another aspect of the present invention, a method of controlling a washing machine comprises the steps of (a) generating a washing mode signal to select one of automatic and manual washing operations of the washing machine according to a user's selection; (b) if the manual washing operation is recognized according to the mode select signal, performing the manual washing operation in accordance with a plurality of washing factors which are selected by the user and a plurality of washing information regarding a washing bath and storing the plurality of washing factors in an accumulated manner in a memory; and (c) if the automatic washing operation is recognized according to the mode select signal, inferring a plurality of washing factors from one of the plurality of washing information regarding the washing bath, analyzing the washing factors stored in the memory when the manual washing operation was performed to recognize those which the user likes best, performing self-learning based on the inferred washing factors, and the recognized washing factors to determine a plurality of final washing factors and performing the automatic washing operation according to the determined final washing factors.

BRIEF DESCRIPTION OF THE DRAWINGS

The above and other objects, features and advantages of the present invention will be more clearly understood from the following detailed description taken in conjunction with the accompanying drawings, in which:

FIG. 6*a* is a memory map of a memory recognizing the washing factors which are preferred by the user; and FIG. 6*b* is a view illustrating one example of washing factors which are stored in an accumulated manner in the memory of FIG. 6*a* during a manual washing operation.

DETAILED DESCRIPTION OF THE PREFERRED EMBODIMENT

Figure 3:
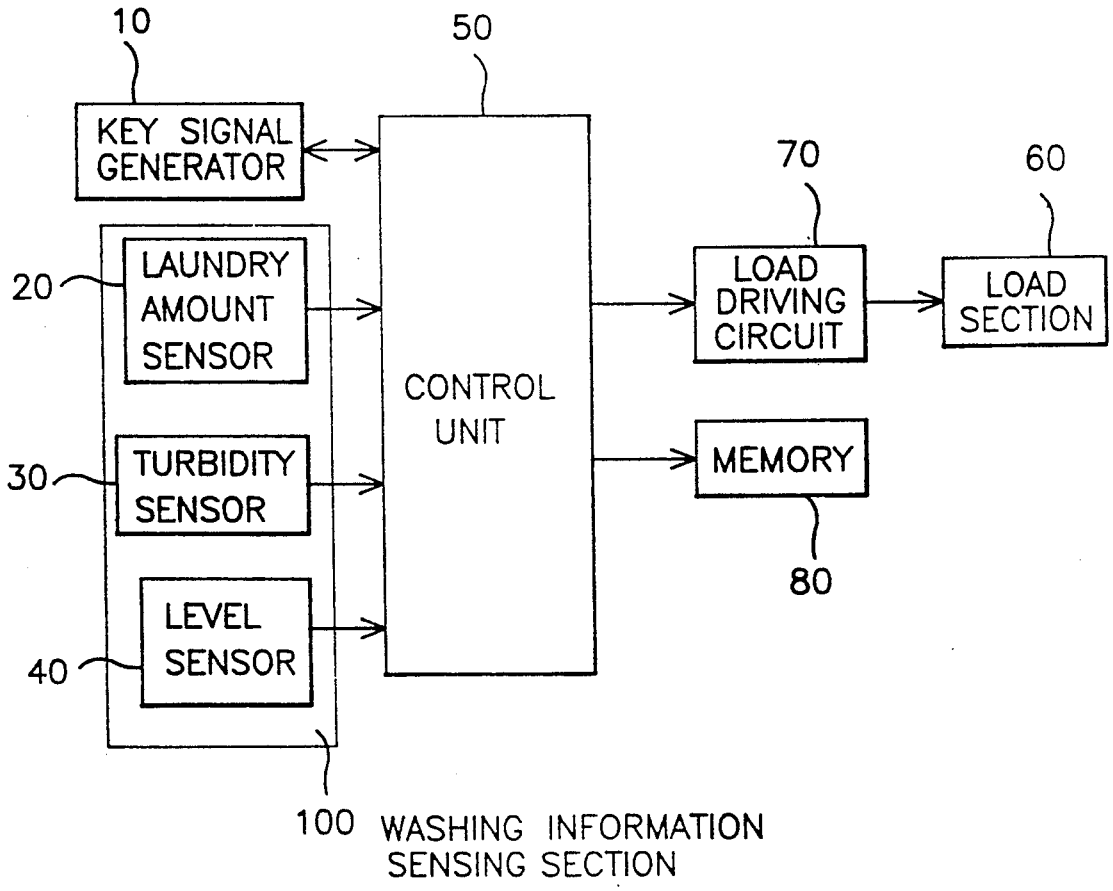
FIG. 3 is a block diagram of a washing machine in accordance with the present invention.

Referring to FIG. 3, there is shown a block diagram of a washing machine in accordance with the present invention. As shown in this drawing, the washing machine of the present invention comprises a key signal generator 10 for generating a washing mode signal to select either an automatic or a manual washing operation and a plurality of washing factors necessary to the manual washing operation, according to a user's selection. The washing factors correspond to a level of washing water, washing time, the number of rinsing times and hydrating time, which are selected by the user.

A washing information sensing section 100 is provided in the washing machine to sense a plurality of washing conditions in a washing bath. The washing information includes an amount of laundry articles, a level of washing water and a turbidity of the washing water in the washing bath.

The washing machine also comprises a memory 80 for storing the plurality of washing factors in an accumulated manner from the key signal generator 10 which are selected by the user whenever the manual washing operation is performed.

A control unit 50 recognizes one of the manual and automatic washing operations in response to the washing mode signal from the key signal generator 10. The control unit 50 also controls the manual washing operation in accordance with the plurality of washing factors from the key signal generator 10 and the plurality of washing information from the washing information sensing section 100. Also, the control unit 50 infers a plurality of washing factors from the plurality of washing information from the washing information sensing section 100 and controls the automatic washing operation according to the inferred washing factors and the plurality of washing factors stored in the memory 80 in the manual washing operation.

The washing machine also comprises a load section 60 for executing the automatic and manual washing operations of the washing machine and a load driving circuit 70 for driving the load section 60 during the automatic washing operation or the manual washing operation under the control of the control unit 50.

The washing information sensing section 100 includes a laundry amount sensor 20 for sensing the amount of the laundry articles in the washing bath, a turbidity sensor 30 for sensing the turbidity of the washing water in the washing bath, and a level sensor 40 for sensing the level of the washing water in the washing bath.

The control unit 50 may be, for example, a microcomputer which is comprised of a memory, a central processing unit (CPU), an interface circuit and an arithmetic logic unit (ALU).

An electrically erasable programmable read only memory (EEPROM) may be used as the memory 80.

The load section 60 includes components necessary to the washing operation of the washing machine, such as, for example, a washing motor, a hydrating motor, a valve for regulating the washing water supplied to the washing bath and etc. The operation of controlling the washing machine of the construction in FIG. 3 in accordance with the present invention will hereinafter be described in detail with reference to FIGS. 4 to 6.

First, the user operates the key signal generator 10 to generate the washing mode signal corresponding to a desired one of the manual and automatic washing operations. Then, the control unit 50 determines whether the washing mode signal corresponds to the automatic washing operation or the manual washing operation, and controls the whole washing operation of the washing machine in accordance with the determined result.

MANUAL WASHING OPERATION

Figure 4:
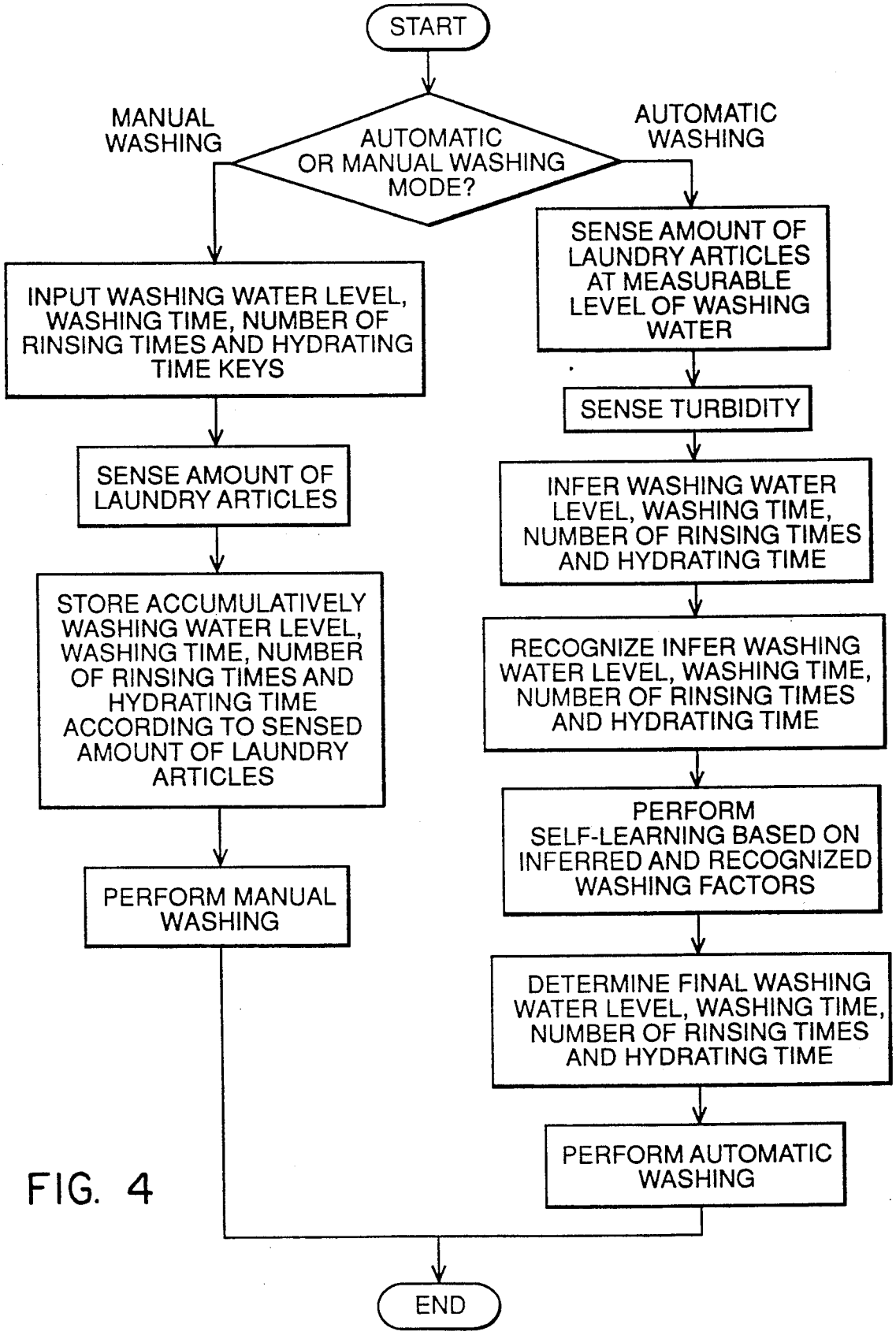
FIG. 4 is a flowchart illustrating a method of controlling the washing machine of FIG. 3 in accordance with the present invention.

Referring to FIG. 4, there is shown a flowchart illustrating a method of controlling the washing machine in FIG. 3 in accordance with the present invention. When the manual washing operation is selected by the user, the key signal generator 10 generates the washing mode signal corresponding to the manual washing operation. Also, the key signal generator 10 generates the washing factors corresponding to the level of the washing water, the washing time, the number of rinsing times and the hydrating time, which are also selected by the user. Also, the laundry amount sensor 20 senses the amount of the laundry articles and provides the sensed result to the control unit 50. The control unit 50 recognizes the manual washing operation in response to the washing mode signal from the key signal generator 10 and then stores the washing factors from the key signal generator 10 in the memory 80 on the basis of the sensed amount of the laundry articles which is provided by the laundry amount sensor 20. On the basis of the level of the washing water, the washing time, the number of rinsing times and the hydrating time, which are selected by the user, and the washing information from the washing information sensing section 100, the control unit 50 controls the load driving circuit 70 to drive the load section 60, so that it controls the manual washing operation.

Figure 1:
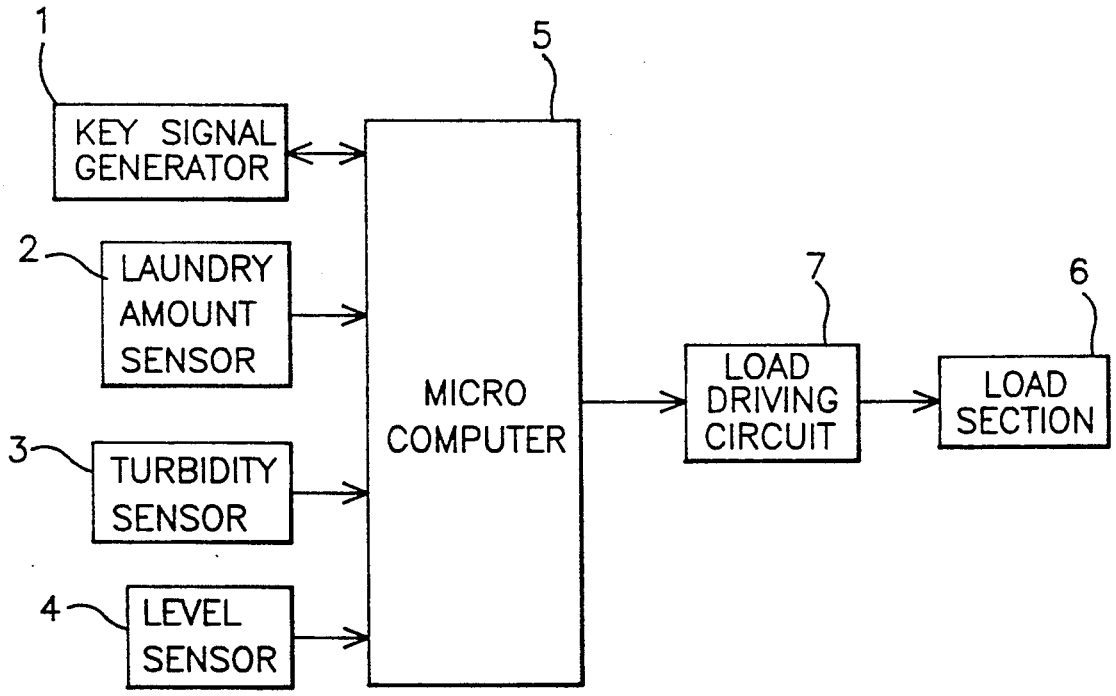
FIG. 1 PRIOR ART.
FIG. 1 is a block diagram of a conventional washing machine.
Figure 2:
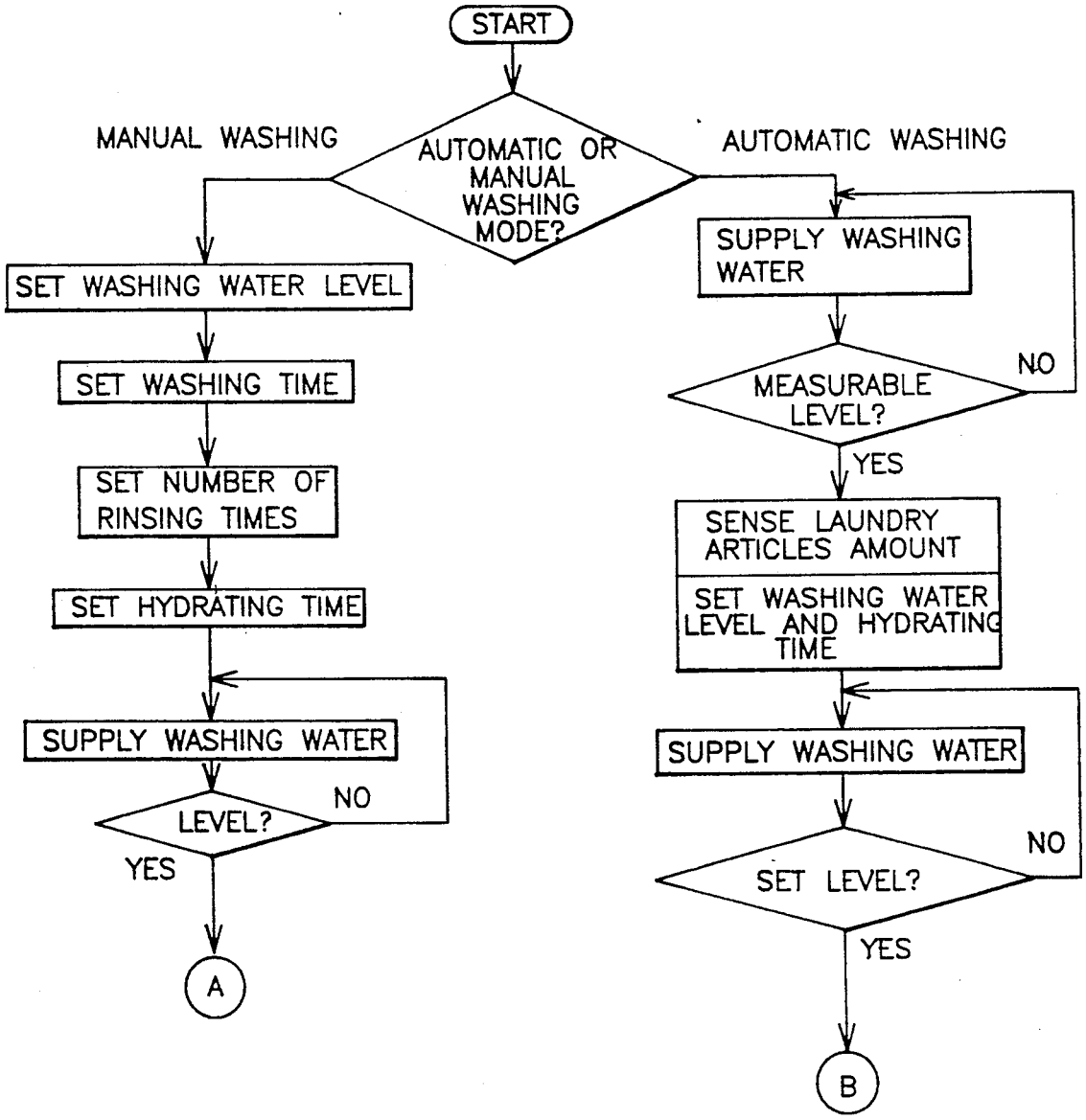
FIG. 2 PRIOR ART
FIG. 2 is a flowchart illustrating a method of controlling the conventional washing machine of FIG. 1.

The manual washing operation according to the present invention is substantially the same as that in FIG. 2, with the exception that the washing factors selected by the user are stored in the memory 80, and a detailed description thereof will thus be omitted.

The storage of the washing factors in the memory 80 are performed whenever the manual washing operation is performed by the user. Upon the storage of the washing factors in the memory 80, the washing factors are classified according to the amount of laundry articles in the washing bath and then the classified washing factors are accumulated. For example, provided that the number of the stored washing factors exceeds a predetermined number, an update may be performed beginning with the oldest washing factors. Alternatively, the update of the washing factors may be performed periodically.

As shown in FIG. 6*a*, memory 80 stores the washing factors in the accumulated manner according to the amount of the laundry articles in the washing bath. It can be seen from the memory map of FIG. 6*a* that the amount of the laundry articles thrown into the washing bath by the user is classified into a plurality of regions such as 0–2 Kg, 2–3 Kg and etc. The control unit 50 determines whether the sensed laundry amount from the laundry amount sensor 20 corresponds with any one of the plurality of regions, which represents a memory location. Then, the control unit 50 accumulates the frequency that the washing machine is used by the user to wash the laundry articles belonging to the corresponding amount region. At this time, the control unit 50 reads the level of the washing water, the washing time, the number of rinsing times and the hydrating time which are selected by the user and stores the read values in the corresponding memory locations under a memory location corresponding to the amount region.

The number of times or the frequencies N1–N5 that the washing machine is used, the level of the washing water H1a-H5d, the washing time T1a-T5d, the number of rinsing times X1a-X5d and the hydrating time Y1a-Y5d stored in the memory 80 are information enabling the washing factors in the automatic washing operation to be obtained according to the user's preference.

FIG. 6*b* illustrates one example of the washing factors which are stored in the accumulated manner in the memory 80 during a manual washing operation. In this drawing, the washing factors, the level of the washing water, the washing time, the number of rinsing times and the hydrating time are stored in an accumulated manner in the memory 80 when the user manually washes the 0–2 Kg laundry articles over ten times.

AUTOMATIC WASHING OPERATION

In accordance with the washing factors selected by the user that are stored in an accumulated manner in the memory 80 whenever the manual washing operation is performed, through a series of steps as mentioned above, the control unit 50, in the automatic washing operation, analyzes the stored washing factors according to a regular rule, so as to recognize those the user likes best. Also, the control unit 50 infers a plurality of washing factors from the washing information provided by the washing information sensing section 100. The inferred washing factors include the level of the washing water, the washing time, the number of rinsing times and the hydrating time. The washing information from the washing information sensing section 100 includes the amount of laundry articles, the level of the washing water, and the turbidity of the washing water in the washing bath, as mentioned above. Then, the control unit 50 performs self-learning based on the recognized washing factors and the inferred washing factors. The control unit 50 determines the final washing factors as a result of the self-learning and performs the automatic washing operation according to the final washing factors.

In other words, when the automatic washing operation is selected by the user, the key signal generator 10 generates the washing mode signal corresponding to the automatic washing operation. The control unit 50 recognizes the automatic washing operation in response to the washing mode signal from the key signal generator 10. At this time, the laundry amount sensor 20 senses the amount of the laundry articles in the washing bath at a measurable level of the washing water and provides the sensed result to the control unit 50. Also, the turbidity sensor 30 senses the turbidity of the washing water in the washing bath and provides the sensed result to the control unit 50. Then, the control unit 50 infers the washing factors, the level of the washing water A, the washing time B, the number of rinsing times C and the hydrating time D, from the sensed amount of the laundry articles and the sensed turbidity of the washing water. The inferred washing factors are values which are preset in the control unit 50, similar to the conventional washing machine, so that the control unit 50 performs a predetermined automatic washing operation on the basis of the washing information from the washing information sensing section 100 regardless of the user's preference.

Then, the control unit 50 analyzes the plurality of washing factors stored in the memory 80 when the manual washing operation was performed according to the regular rule (defined in a system program), so as to recognize those which the user likes best. The control unit 50 compares the inferred washing factors with the recognized washing factors to determine the final washing factors (the level of the washing water, the washing time, the number of rinsing times and the hydrating time). As a result, the control unit 50 performs the subsequent automatic washing operation according to the final washing factors.

The automatic washing operation of the present invention includes a series of steps in which the control unit 50 controls the load driving circuit 70 to drive the load section 60, retrieving the final washing factors (the level of the washing water, the washing time, the number of rinsing times and the hydrating time). The series of steps are the same as those in FIG. 2 and a description thereof will thus be omitted.

The regular rule is previously defined in the system program, thereby allowing the control unit 50 to recognize the washing factors that the user likes best, from the stored washing factors. For example, the control unit 50 receives the washing water level, the washing time, the number of rinsing times and the hydrating time having the highest frequencies in the sensed laundry articles amount region in the memory 80 and recognizes the received washing water level, washing time, number of rinsing times and hydrating time as the washing factors that the user likes best when washing the sensed amount of the laundry articles. Alternatively, the control unit 50 may recognize the washing factors that the user likes best by taking the respective averages of the stored washing factors or values within predetermined deviations.

FIG. **6*b* shows the washing factors having the highest frequencies in the 0–2 Kg laundry articles amount region stored in the memory 80. The washing factors in FIG. 6*b* may be recognized as the washing factors that the user likes best. Namely, the recognized washing factors are as follows: the level of the washing water=-low=Href, the washing time=12 minutes=Tref, the number of rinsing times=3**=Xref and the hydrating time=1 minute=Yref.

Figure 5:
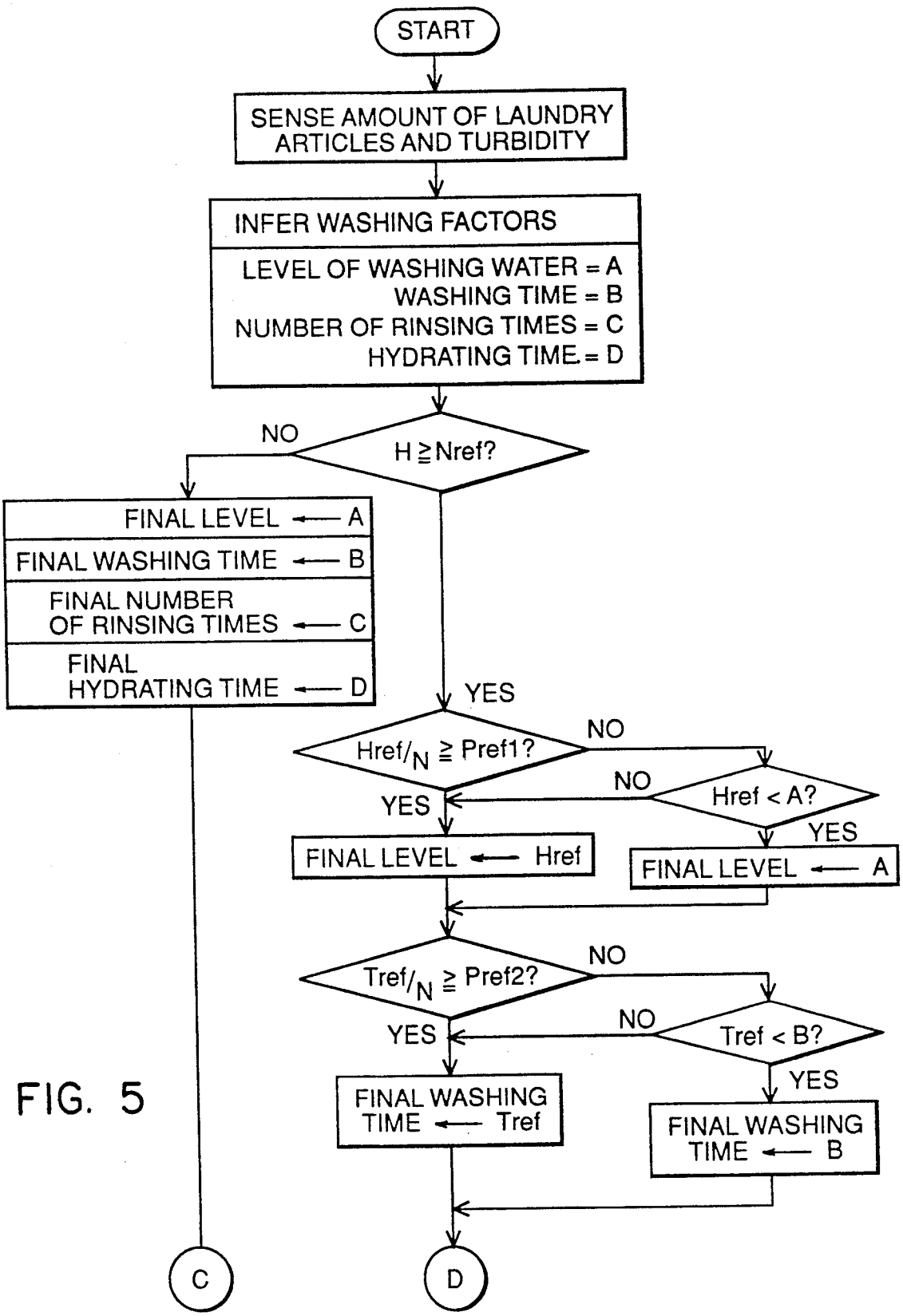
FIG. 5 is a flowchart illustrating the recognition of washing factors which are preferred by the user and self-learning in accordance with the present invention.

The control unit 50 performs the self-learning as shown in FIG. 5 on the basis of the recognized washing factors. First, the control unit 50 calculates accounting ratios equal to the frequencies of the recognized washing factors Href, Tref, Xref and Yref divided by the total frequencies and compares the calculated accounting ratios with predetermined reference accounting ratios Pref1-Pref4 in the system program. The comparison of the accounting ratios is performed before comparing the inferred washing factors, the level of the washing water A, the washing time B, the number of rinsing times C and the hydrating time D, with the recognized washing factors Href, Tref, Xref and Yref to determine the final washing factors.

As a result of the comparison of the accounting ratios, one of the recognized level of the washing water Href and the inferred level of the washing water A, one of the recognized washing time Tref and the inferred washing time B, one of the recognized number of rinsing times Xref and the inferred number of rinsing times C, and one of the recognized hydrating time Yref and the inferred hydrating time D are determined as the final washing factors.

To put it more concretely with reference to FIGS. 5 and **6*b*, if the total frequency N in the corresponding laundry articles amount (for example, 0–2 Kg) is smaller than a predetermined reference frequency Nref (for example, 5 times), an error may occur in the recognition of the washing factors that the user likes best, due to a shortage of the frequency. In this case, the final washing factors are determined to be the washing water A, the washing time B, the number of rinsing times C and the hydrating time D inferred from the washing information from the washing information sensing section 100**.

On the other hand, in the case where the total frequency N (for example, 10 times) in the corresponding laundry articles amount is greater than or equal to the predetermined reference frequency Nref (for example, 5 times), first, a ratio Href/N equal to the recognized level of washing water Href divided by the total frequency N is calculated and the calculated accounting ratio Href/N is compared with predetermined reference accounting ratio Prefl (0.7=70% in the preferred embodiment) in the system program. When the calculated accounting ratio Href/N is greater than or equal to the predetermined reference accounting ratio Prefl, the recognized level of the washing water Href (for example, low) is determined as the final washing water level. On the contrary, if the calculated accounting ratio Href/N is smaller than the predetermined reference accounting ratio Prefl, the recognized level of the washing water Href is compared with the inferred washing water level A. When the recognized level of the washing water Href is greater than or equal to the inferred washing water level A, the recognized level of the washing water Href is determined as the final washing water level. If the recognized level of the washing water Href is smaller than the inferred washing water level A, the inferred level of the washing water A is determined as the final level of the washing water.

Then, a ratio Tref/N (for example, 7/10) equal to the frequency of the recognized washing time Tref divided by the total frequency N is calculated and the calculated accounting ratio Tref/N is compared with predetermined reference accounting ratio Pref2 (70% in the preferred embodiment) in the system program. When the calculated accounting ratio Tref/N is greater than or equal to the predetermined reference accounting ratio Pref2, the recognized washing time Tref (for example, 12 minutes) is determined as the final washing time. On the contrary, if the calculated accounting ratio Tref/N is smaller than the predetermined reference accounting ratio Pref2, the recognized washing time Tref is compared with the inferred washing time B. When the recognized washing time Tref is greater than or equal to the inferred washing time B, the recognized washing time Tref is determined as the final washing time. If the recognized washing time Tref is smaller than the inferred washing time B, the inferred washing time B is determined as the final washing time.

Then, a ratio Xref/N (for example, 9/10) equal to the frequency of the recognized number of rinsing times Xref divided by the total frequency N is calculated and the calculated accounting ratio Xref/N is compared with predetermined reference accounting ratio Pref3 (70% in the preferred embodiment) in the system program. When the calculated accounting ratio Xref/N is greater than or equal to the predetermined reference accounting ratio Pref3, the recognized number of rinsing times Xref (for example, 3 times) is determined as the final number of rinsing times. On the contrary, if the calculated accounting ratio Xref/N is smaller than the predetermined reference accounting ratio Pref3, the recognized number of rinsing times Xref is compared with the inferred number of rinsing times C. When the recognized number of rinsing times Xref is greater than or equal to the inferred number of rinsing times C, the recognized number of rinsing times Xref is determined as the final number of rinsing times. If the recognized number of rinsing times Xref is smaller than the inferred number of rinsing times C, the inferred number of rinsing times C is determined as the final number of rinsing times.

Finally, a ratio Yref/N (for example, 5/10) equal to the frequency of the recognized hydrating time Yref divided by the total frequency N is calculated and the calculated accounting ratio Yref/N is compared with predetermined reference accounting ratio Pref4 (70% in the preferred embodiment) in the system program. When the calculated accounting ratio Yref/N is greater than or equal to the predetermined reference accounting ratio Pref4, the recognized hydrating time Yref (for example, 1 minute) is determined as the final hydrating time. On the contrary, if the calculated accounting ratio Yref/N is smaller than the predetermined reference accounting ratio Pref4, the recognized hydrating time Yref is compared with the inferred hydrating time D. When the recognized hydrating time Yref is greater than or equal to the inferred hydrating time D, the recognized hydrating time Yref is determined as the final hydrating time. If the recognized hydrating time Yref is smaller than the inferred hydrating time D, the inferred hydrating time D is determined as the final hydrating time.

Upon determination of the final washing factors, the level of the washing water, the washing time, the number of rinsing times and the hydrating time, in the above manner, the control unit 50 performs the automatic washing operation on the basis of the final washing factors.

As hereinbefore described, according to the present invention, the washing factors can be determined through self-learning based on the user's preference and the automatic washing operation can be performed according to the determined washing factors. Therefore, the washing of the laundry articles can be performed according to the user's preference.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A washing machine comprising:

key signal generating means for generating a washing mode signal to select one of automatic and manual washing operations and a plurality of washing factors necessary to perform the manual washing operation according to user selections;

washing information sensing means for sensing a plurality of washing information regarding conditions in a washing bath;

memory means for storing in an accumulated manner the plurality of washing factors from said key signal generating means which are selected by the user whenever the manual washing operation is performed;

control means for recognizing one of the manual and automatic washing operations in response to the washing mode signal from said key signal generating means, for controlling the manual washing operation in accordance with the plurality of washing factors from said key signal generating means and the plurality of washing information from said washing information sensing means, for inferring a plurality of washing factors from the plurality of washing information from said washing information sensing means, and for controlling the automatic washing operation according to the inferred washing factors and the plurality of washing factors stored in said memory means when the manual washing operation was performed;

load means for executing the automatic and manual washing operations of the washing machine; and load driving means for driving said load means in the automatic washing operation or the manual washing operation under the control of said control means.

2. A washing machine as set forth in claim 1, wherein said plurality of washing factors include a level of washing water, a washing time, a number of rinsing times, and a hydrating time.

3. A washing machine as set forth in claim 1, wherein said plurality of washing information include a level of washing water, an amount of laundry articles, and a turbidity of the washing water in said washing bath.

4. A washing machine as set forth in claim 1, wherein said washing information sensing means includes:

a level sensor for sensing the level of washing water in said washing bath;

a turbidity sensor for sensing the turbidity of the washing water in said washing bath; and a laundry amount sensor for sensing the amount of laundry articles in said washing bath.

5. A washing machine as set forth in claim 1, wherein said memory means includes an EEPROM.

6. A method of controlling a washing machine, comprising the steps of:

generating a washing mode signal to select one of automatic and manual washing operations of the washing machine according to user selection;

if the manual washing operation is indicated by the mode select signal, performing the manual washing operation in accordance with a plurality of washing factors which are selected by the user and a plurality of washing information regarding conditions in a washing bath and storing the plurality of washing factors in an accumulated manner in a memory; and if the automatic washing operation is indicated by the mode select signal, inferring a plurality of washing factors from one of the plurality of washing information, analyzing the washing factors stored in said memory when the manual washing operation was performed to recognize those which the user prefers, performing self-learning based on the inferred washing factors and the recognized washing factors to determine a plurality of final washing factors, and performing the automatic washing operation according to the determined final washing factors.

7. A method of controlling a washing machine, as set forth in claim 6, wherein said one of the plurality of washing information used in the inference of the washing factors is an amount of laundry articles in the washing bath.

8. A method of controlling a washing machine, as set forth in claim 6, wherein said plurality of washing factors include a level of washing water, a washing time, a number of rinsing times, and a hydrating time.

9. A method of controlling a washing machine, as set forth in claim 6, wherein said plurality of washing information include a level of washing water, an amount of laundry articles and a turbidity of the washing water in said washing bath.

10. A method of controlling a washing machine, as set forth in claim 6, wherein the step of storing the washing factors in the manual washing operation includes the steps of:

accumulating a frequency of the washing machine in a region of the memory corresponding to the one of the plurality of washing information for the inference of the washing factors; and storing the plurality of washing factors which are selected by the user in the accumulated manner in said memory region.

11. A method of controlling a washing machine, as set forth in claim 10, further including the step of determining the inferred washing factors as the final washing factors when a total frequency corresponding to the one of the plurality of washing information is smaller than a predetermined reference frequency.

12. A method of controlling a washing machine, as set forth in claim 6, wherein the recognized washing factors are the most frequently used of the washing factors stored during the manual washing operation.

13. A method of controlling a washing machine, as set forth in claim 6, further including the steps of calculating accounting ratios by dividing frequencies of the recognized washing factors by corresponding total frequencies of the washing machine and determining the inferred washing factors or the recognized washing factors as the final washing factors according to the calculated accounting ratios.

14. A method of controlling a washing machine, as set forth in claim 13, further including the step of determining the inferred washing factors as the final washing factors when the accounting ratios of the recognized washing factors are smaller than predetermined reference accounting ratios and the recognized washing factors are smaller than the inferred washing factors.

15. A method of controlling a washing machine, as set forth in claim 14, wherein the predetermined reference accounting ratios are previously defined for determination of the final washing factors in the case where it is difficult to recognize user preference.

16. A method of controlling a washing machine, as set forth in claim 13, further including the step of determining the recognized washing factors as the final washing factors when the accounting ratios of the recognized washing factors are greater than or equal to predetermined reference accounting ratios and the recognized washing factors are greater than or equal to the inferred washing factors.

17. A method of controlling a washing machine, as set forth in claim 16, wherein said predetermined reference accounting ratios are previously defined for determination of the final washing factors in the case where it is difficult to recognize user preference.

* * * * *